US006450158B2

(12) United States Patent
Takahashi et al.

(10) Patent No.: US 6,450,158 B2
(45) Date of Patent: Sep. 17, 2002

(54) AIR-FUEL RATIO FEEDBACK CONTROL APPARATUS OF INTERNAL COMBUSTION ENGINE AND METHOD THEREOF

(75) Inventors: Koji Takahashi; Shigeo Ohkuma; Hajime Hosoya; Hidekazu Yoshizawa, all of Atsugi (JP)

(73) Assignee: Unisia Jecs Corporation, Kanagawa-Ken (JP)

( * ) Notice: Subject to any disclaimer, the term of this patent is extended or adjusted under 35 U.S.C. 154(b) by 6 days.

(21) Appl. No.: 09/805,946

(22) Filed: Mar. 15, 2001

(30) Foreign Application Priority Data

Mar. 15, 2000 (JP) ..... 2000-072325

(51) Int. Cl.[7] ..... F02D 41/14
(52) U.S. Cl. ..... 123/681; 123/687; 701/109
(58) Field of Search ..... 123/687, 681, 123/672; 701/109

(56) References Cited

U.S. PATENT DOCUMENTS 6,195,988 B1 * 3/2001 Yasui et al. ..... 123/674
6,266,605 B1 * 7/2001 Yasui et al. ..... 60/276
6,292,739 B1 * 9/2001 Yasui et al. ..... 60/276
6,351,943 B1 * 3/2002 Tagami et al. ..... 123/679
6,370,473 B1 * 4/2002 Yasui et al. ..... 123/692

FOREIGN PATENT DOCUMENTS

JP 8-232713 9/1996
JP 9-274504 10/1997

* cited by examiner

*Primary Examiner*—Erick Solis
(74) *Attorney, Agent, or Firm*—Sughrue Mion, PLLC

(57) ABSTRACT

In a sliding mode control for restraining an air-fuel ratio state on a switching line set on a phase plane shown by a deviation between an actual air-fuel ratio and a target air fuel ratio, and a differential value of the deviation, an inclination of the switching line is made small, when the smaller an intake air quantity is, the longer a detection delay time of the air-fuel ratio is.

18 Claims, 5 Drawing Sheets

107
K1
ENGINE ROTATION SPEED
108
K2
DIFFERENTIAL VALUE OF ROTATION
109
K = K1 + K2
103
S = K (ERROR AMOUNT-q) + ERROR DIFFERENTIAL VALUE
1.0
106
FEEDBACK CORRECTION COEFFICIENT COMPUTING UNIT
102
DIFFERENTIAL COMPUTING UNIT
104
NONLINEAR PORTION = NONLINEAR PORTION GAIN × S/|S|
105
LINEAR PORTION = LINEAR PORTION GAIN × ERROR AMOUNT
101
ERROR COMPUTING UNIT
ACTUAL AIR-FUEL RATIO
TARGET AIR-FUEL RATIO

AIR-FUEL RATIO FEEDBACK CONTROL APPARATUS OF INTERNAL COMBUSTION ENGINE AND METHOD THEREOF

FIELD OF THE INVENTION

The present invention relates to an air-fuel ratio feedback control apparatus of an internal combustion engine and a method thereof, in particular, to technology for feedback controlling an air-fuel ratio of a combustion mixture using a sliding mode control to a target air-fuel ratio.

RELATED ART OF THE INVENTION

One conventional feedback control of an air-fuel ratio using a sliding mode control has been proposed in Japanese Unexamined Patent Publication No. 8-232713.

Also, Japanese Unexamined Patent Publication No. 9-274504 discloses a construction that a convergence response characteristic and a convergence stability to an equilibrium point (a target air-fuel ratio) are both obtained by changing an inclination of a hyper plane (a switching line) in accordance with convergence states to the hyper plane (the switching line).

To be specific, in a state substantially converged to the hyper plane (the switching line), the inclination is changed to increase, while in a non-convergence state to the hyper plane (the switching line), the inclination is changed to reduce.

When an air-fuel ratio is feedback controlled, it is common to detect an actual air-fuel ratio based upon an oxygen concentration in the exhaust gas. However, in this case, a delay in an air-fuel ratio detection occurs due to a transport delay of exhaust gas, and when such a detection delay is large, the convergence stability to the hyper plane (the switching line) is deteriorated.

Since, in the air-fuel ratio feedback control disclosed in Japanese Unexamined Patent Publication No. 9-274504, the inclination is changed after the non-convergence state to the hyper plane (the switching line) is judged, a change in inclination is delayed. Thus, there are cases that the convergence response characteristic and the convergence stability to the target air-fuel ratio in the air-fuel ratio feedback control are not obtained at a high level.

SUMMARY OF THE INVENTION

The present invention, in view of the foregoing problems, has been achieved and has an object of providing an air-fuel ratio feedback control apparatus and a method thereof using a sliding mode control wherein a convergence response characteristic and a convergence stability are always both obtained at a high level by setting a hyper plane (a switching line) of an appropriate inclination in accordance with a delay in air-fuel ratio detection even when the detection delay is changed due to a change in operating conditions.

In order to achieve the above object, with the present invention, the construction is such that an actual air-fuel ratio is feedback controlled to a target air-fuel ratio using a sliding mode control which restrains the air-fuel ratio state on the switching line set on a phase plane shown by a deviation between the actual air-fuel ratio and a target air-fuel ratio and by a differential value of the deviation wherein an inclination of the switching line is changed corresponding to a change in a dead time of a feedback control based upon engine operating conditions.

According to this construction, the switching line is set on the phase plane shown by the deviation between the actual air-fuel ratio and the target air-fuel ratio, and the differential value of the deviation. The air-fuel ratio is restrained on the switching line to be feedback controlled so as to approach an origin (the target air-fuel ratio), and the inclination of the switching line is changed corresponding to the dead time of feedback control in accordance with the engine operating conditions.

Accordingly, the inclination of the switching line is set in advance to an appropriate value corresponding to the dead time, the convergence stability and the convergence response characteristic to the target air-fuel ratio are improved, thereby capable of reducing a transient error of air-fuel ratio.

Here, the dead time may be set as a detection delay time of air-fuel ratio so that the inclination of the switching line may be set in accordance with the engine operating conditions participating in the detection delay time.

According to this construction, when an air-fuel ratio is detected based upon an oxygen concentration in the exhaust gas, since the detection delay time of air-fuel ratio is changed in accordance with the engine operating conditions, an engine operating condition affecting the detection delay time of air-fuel ratio is detected and the inclination of the switching line is changed in accordance with the detected engine operating condition.

The engine operating condition participating in the detection delay time of air-fuel ratio can be set as an engine intake air quantity so that the inclination of the switching line can be set in accordance with the intake air quantity. Further, it is preferable that the inclination set in accordance with the intake air quantity is corrected in accordance with a differential value of the intake air quantity.

Other objects and features of the present invention will be understood from the following description with reference to the accompanying drawings.

PREFERRED EMBODIMENT

Figure 1:
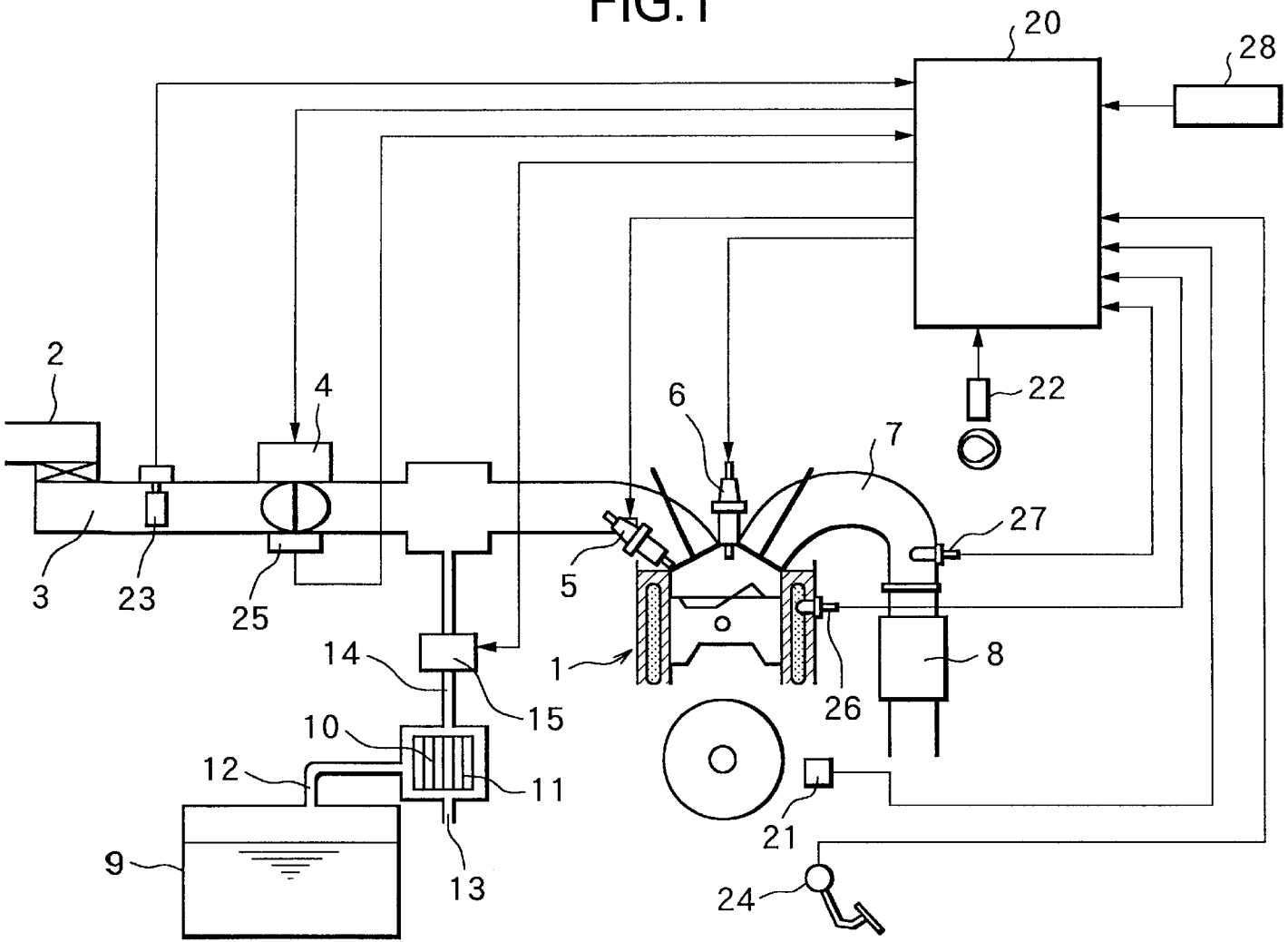
FIG. 1 is a diagram showing a system structure of an internal combustion engine.

FIG. 1 is a diagram showing a system structure of an internal combustion engine 1.

In FIG. 1, air is sucked into a combustion chamber of each cylinder of an internal combustion engine 1 mounted on a vehicle via an air cleaner 2, an intake passage 3, and an electronically controlled throttle valve 4 driven to open or close by a motor. An electromagnetic injection valve 5 is mounted for directing injecting fuel (gasoline) into the combustion chamber of each cylinder and an air-fuel mixture is formed in the combustion chamber by the fuel injected from the injection valve 5 and the sucked air.

The injection valve 5 is supplied with an electric current to be connected to a solenoid by an injection pulse signal output from a control unit 20 and injects fuel adjusted to a predetermined pressure. Then, the injected fuel, during an intake stroke injection, is diffused within the combustion chamber to form a homogeneous mixture, while during a compression stroke injection, forms a stratified mixture concentratedly around an ignition plug 6. The mixture formed in the combustion chamber is ignited and combusted by the ignition plug 6.

The internal combustion engine 1 is not limited to the direct injection type gasoline engine and may be an engine constructed to inject fuel into an intake port.

An exhaust gas from the engine 1 is discharged from an exhaust passage 7. A catalytic converter 8 for exhaust purification is disposed to the exhaust passage 7.

There is a fuel vapor treatment device that performs combustion processing of fuel vapor generated in a fuel tank 9.

A canister 10 is a closed vessel that is filled with an adsorbent 11 such as active carbon, and is connected with a fuel vapor conduit 12 extending from the fuel tank 9. Accordingly, the fuel vapor generated in the fuel tank is introduced via the fuel vapor conduit 12 to the canister 10, to be adsorbed and caught therein.

The canister 10 also is formed with a new air introduction opening 13 and a purge piping 14 is extended from the canister 10. The purge piping 14 is disposed with a purge control valve 15 that is controlled to open or close by a control signal from a control unit 20.

In the above construction, when the purge control valve 15 is controlled to open, an intake negative pressure of the engine 1 forces on the canister 10. As a result, air introduced from the new air introduction opening 13 purges the fuel vapor adsorbed in the adsorbent 11 in the canisters 0 and the purge air is sucked to the downstream of the throttle valve 4 disposed in the intake passage 3 via the purge piping 14 to be subjected to combustion processing in the combustion chamber of the engine 1.

The control unit 20 is equipped with a microcomputer comprising CPU, ROM, RAM, A/D converter, input/output interface and so forth. The control unit 20 receives input signals from various sensors, and performs computations based upon these input signals to control operations of the fuel injection valve 5, the ignition plug 6, the purge control valve 15 and the like.

As the above various sensors, a crank angle sensor 21 for detecting a crank angle of the engine 1 and a cam sensor 22 for taking a cylinder discrimination signal out of a camshaft are disposed, and an engine rotation speed is calculated based upon a signal from the crank angle sensor 21.

As the other sensors, there are disposed an air flow meter 23 for detecting an intake air flow quantity Qa at the upstream of the throttle valve 4 of the intake passage 3, an acceleration sensor 24 for detecting a depressed amount (acceleration opening) APS of an acceleration pedal, a throttle sensor 25 for detecting an opening degree TVO of the throttle valve 4, a water temperature sensor 26 for detecting a cooling water temperature Tw of the engine 1, a wide range type air-fuel ratio sensor 27 for linearly detecting an air-fuel ratio of the combustion mixture in accordance with an oxygen concentration of exhaust gas, and a vehicle speed sensor 28 for detecting a vehicle speed VSP.

Figure 2:
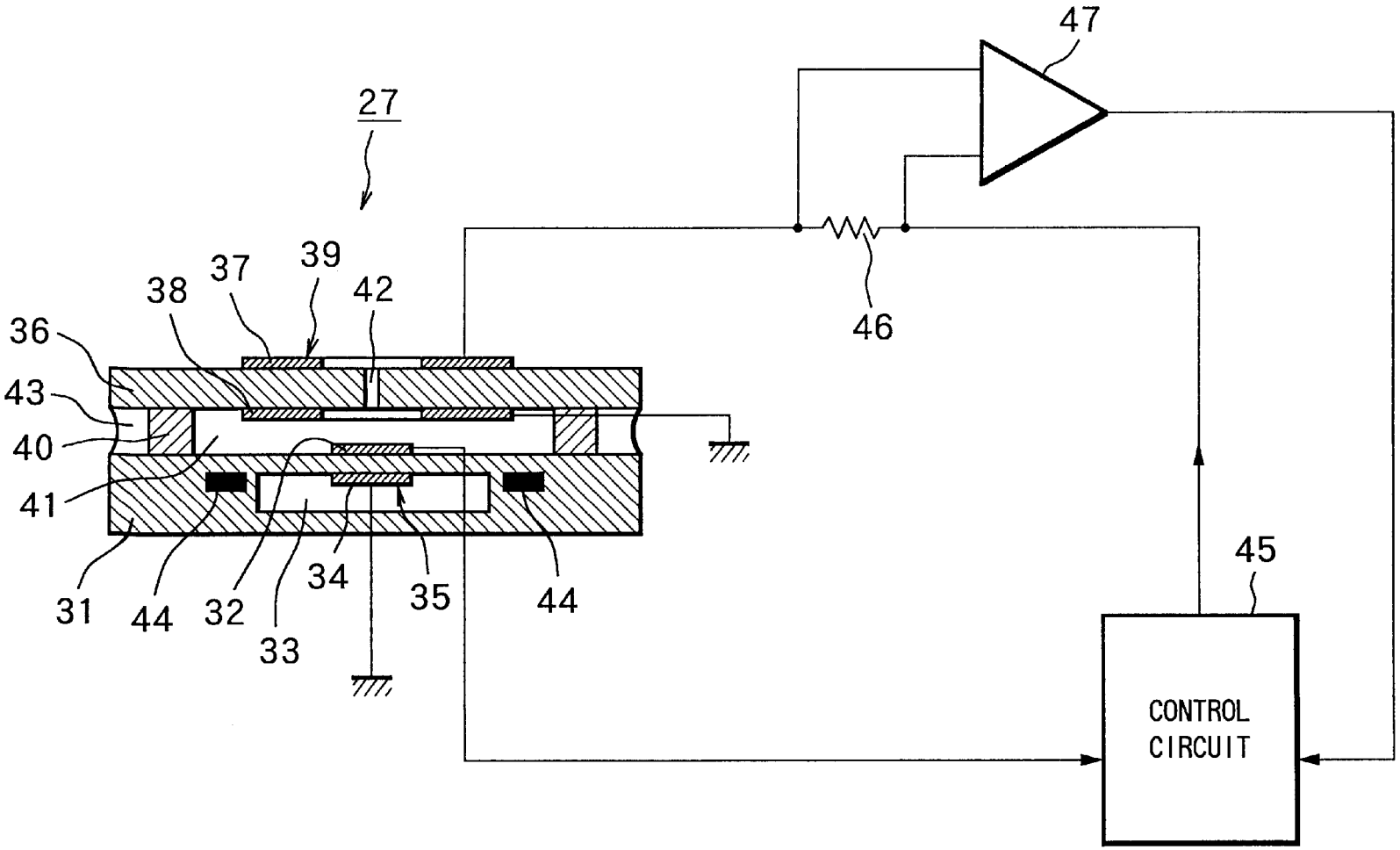
FIG. 2 is a diagram showing an air-fuel ratio sensor and a peripheral circuit thereof.

A structure of the wide range type air-fuel ratio sensor 27 will be explained based upon FIG. 2.

On a substrate 31 made of a solid electrolyte material such as zirconia (ZrO2) is disposed a positive electrode 32 for measuring the oxygen concentration. The substrate 31 is formed with an air introduction hole 33 through which air is introduced. The air introduction hole 33 is mounted with a negative electrode 34 so as to face the positive electrode 32.

Thus, an oxygen concentration detection unit 35 is made up with the substrate 31, the positive electrode 32 and the negative electrode 34.

A pair of platinum pump electrodes 37, 38 are provided on both faces of a solid electrolyte material 36 made of zirconia and the like, to form an oxygen pump unit 39.

The oxygen pump unit 39 is laid through a frame shape spacer 40 above the oxygen concentration detection unit 35 to form a hollow chamber 41 between the oxygen concentration detection unit 35 and the oxygen pump unit 39. An introduction hole 42 is formed on the solid electrode material 36 of the oxygen pump unit 39 for introducing the engine exhaust gas into the hollow chamber 41.

A periphery of the spacer 40 is filled with a glass adhesive agent 43 to ensure the sealing of the hollow chamber 41 and to fixedly couple the substrate 31 and the spacer 40 with the solid electrolyte material 36. Since the spacer 40 and the substrate 31 are coupled to each other by simultaneous baking, the sealing of the hollow chamber 41 is secured by adhering the spacer 40 and the solid electrolyte material 36. A heater 44 is incorporated in the oxygen concentration detection unit 39.

The oxygen concentration of the exhaust gas introduced into the hollow chamber 41 via the introduction hole 42 is detected based upon a voltage of the positive electrode 32. To be specific, an oxygen ion current flows in the substrate 31 in accordance with a difference between the atmospheric oxygen in the air introduction hole 33 and the oxygen in the exhaust gas in the hollow chamber 41. With this current flow, a voltage corresponding to the oxygen concentration of the exhaust gas is generated in the positive electrode 32.

A value of electric current to be flown in the oxygen pump unit 39 is variably controlled to maintain the atmosphere in the hollow chamber 41 to be constant (for example, a theoretical air-fuel ratio) in accordance with the detection result so that the oxygen concentration of the exhaust gas is detected based upon the current value at that time.

Specifically, after the voltage of the positive electrode 32 is subjected to amplification processing by a control circuit 45, the amplified voltage is applied via a voltage detection resistor 46 between the electrodes 37 and 38 so that the oxygen concentration of the hollow chamber 41 is maintained to be constant.

For example, when an air-fuel ratio in a lean region where the oxygen concentration in the exhaust gas is high is detected, a voltage is applied to the outer pump electrode 37 set as a positive electrode and to the pump electrode 38 on the side of the hollow chamber 41 set as a negative electrode. Then, oxygen (oxygen ion $O^{2-}$) in proportion to the current is taken out to the outside from the hollow chamber 41. When the applied voltage reaches a predetermined value or above, the flowing current reaches a limit value. By measuring this limit value by the control circuit 45, the oxygen concentration of the exhaust gas, in other words, the air-fuel ratio is detected.

To the contrary, if oxygen is taken in the hollow chamber 41 by setting the pump electrode 37 as a negative electrode and the pump electrode 38 as a positive electrode, the air-fuel ratio is detected in a rich region where the oxygen concentration of the exhaust gas is low.

This limit current is detected from an output voltage of a differential amplifier 47 for detecting a voltage between terminals of the voltage detection resister 46.

The control unit 20 carries out an air-fuel ratio feedback control by a sliding mode control according to the present invention so that the air-fuel ratio (actual air-fuel ratio) detected by the air-fuel ratio sensor 27 is in conformity with a target air-fuel ratio in accordance with operating conditions, when a predetermined air-fuel ratio control condition is established.

Figure 3:
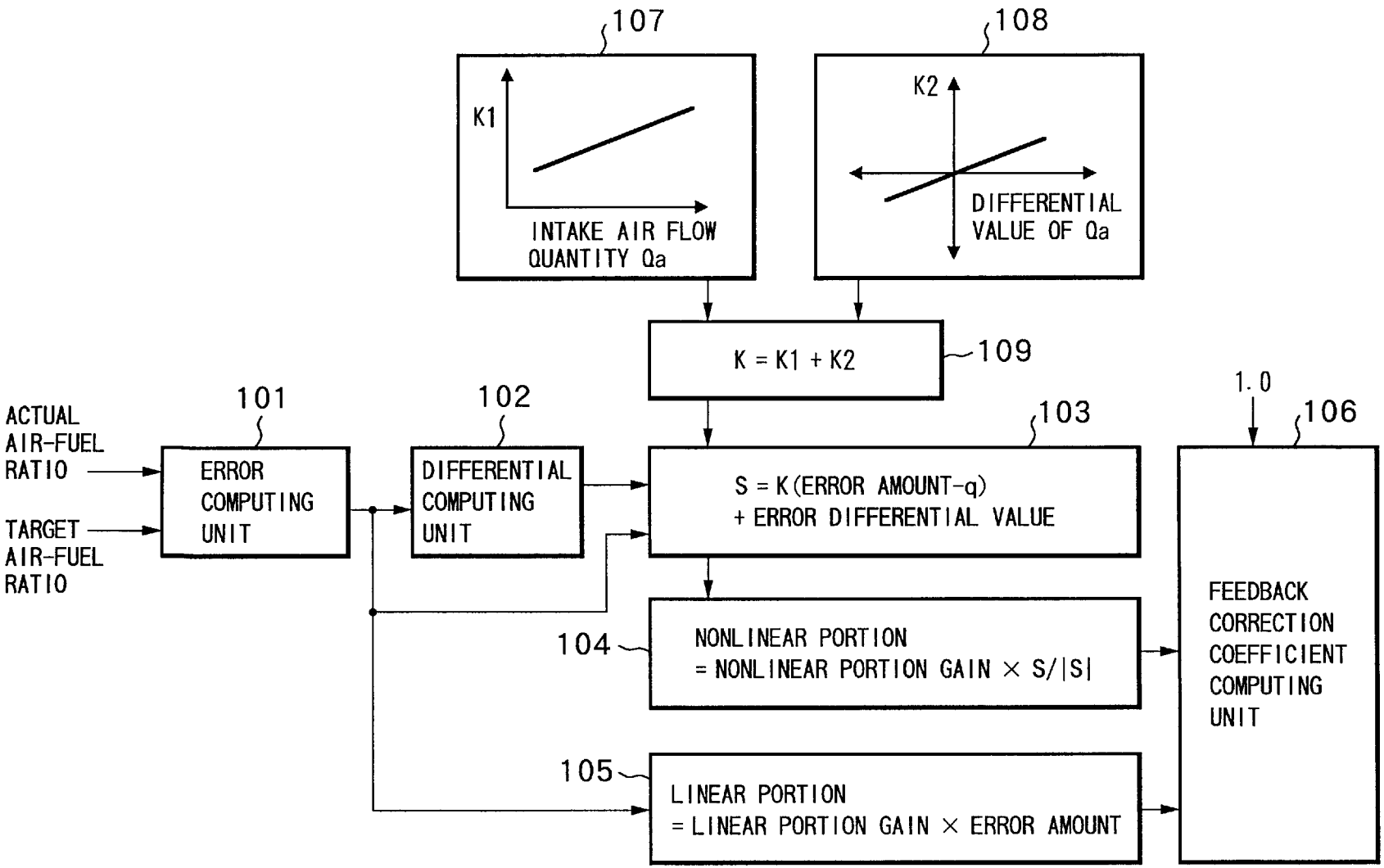
FIG. 3 is a control block diagram showing an air-fuel ratio feedback control for setting an inclination of a switching line in accordance with an intake air quantity.

FIG. 3 is a block diagram showing an air-fuel ration feedback control by the sliding mode control.

At an error computing unit 101 of FIG. 3, an air-fuel ratio error amount (air-fuel ratio deviation) is computed according to the following equation based upon a target air-fuel ratio set in accordance with engine operating conditions (load, rotation, water temperature and the like) and an actual air-fuel ratio detected by the air-fuel ratio sensor 27.

$$\text{Error amount}=\text{actual air-fuel ratio}-\text{target air-fuel ratio}.$$

At a differential computing unit 102, a differential value of the error amount is computed.

At a switching function computing unit 103, a switching function S is set as follows based upon the error amount, the differential value of the error amount and an inclination coefficient K.

$$S=K\times(\text{error amount}-\text{predetermined value q})+\text{differential value}$$

At a nonlinear portion computing unit 104, a nonlinear portion is computed according to the following equation based upon the switching function S.

$$\text{Nonlinear portion}=\text{nonlinear portion gain}\times S/|S|.$$

On the other hand, at a linear portion computing unit 105, a linear portion is computed according to the following equation based upon the error amount.

$$\text{Linear portion}=\text{linear portion gain}\times\text{error amount}.$$

At an air-fuel ratio feedback correction coefficient computing unit 106, a new air-fuel ratio feedback correction coefficient $\alpha$ is computed by adding the nonlinear portion, the linear portion and a median value (=1.0) of the air-fuel ratio feedback correction coefficient $\alpha$.

$$\alpha=1.0+\text{nonlinear portion}+\text{linear portion}.$$

The air-fuel ratio feedback correction coefficient $\alpha$ is multiplied on a basic fuel injection quantity computed in accordance with the engine operating conditions. The multiplied outcome is set as a final fuel injection quantity so that fuel is injected by outputting to the fuel injection valve 5 an injection pulse signal with a pulse width corresponding to the final fuel injection quantity.

Figure 4:
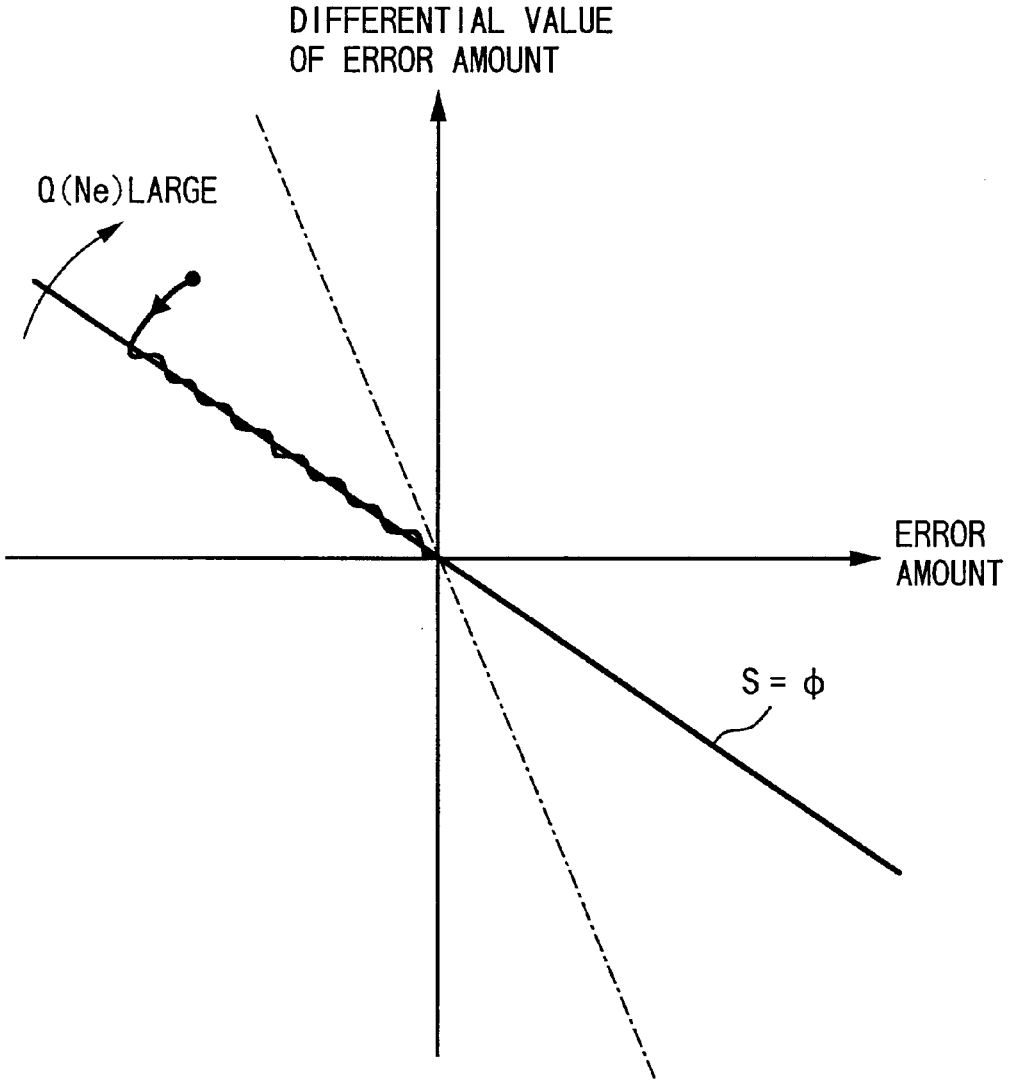
FIG. 4 is a diagram showing a state of a sliding mode control.

The linear portion moves an air-fuel ratio state to a target value along the switching line (S=0), and the nonlinear portion directs the air-fuel ratio state toward the switching line (S=0) and operates to restrain the air-fuel ratio state on the switching line (S=0). Accordingly, the air-fuel ratio state is directed to the switching line (S=0) on a phase plane shown by the error amount and the differential value of the error amount. When the air-fuel ratio state gets on the switching line (S=0), the air-fuel ratio state will reach an origin (target air-fuel ratio) while being restrained to slide on the switching line (S=0) (See FIG. 4).

Herein, an inclination coefficient K used at the switching function computing unit 103 is set as follows.

First, at a basic value computing unit 107, K 1 which is a basic value of the inclination coefficient K is set in accordance with the intake air flow quantity Qa detected by the air flow meter 23. To be specific, a greater value is set as the inclination coefficient K when the intake air flow quantity Qa is larger, to make the inclination of the switching line steep.

The detection delay time until a change in the air-fuel ratio of the combustion mixture is detected by the air-fuel ratio sensor 27, is a dead time of the air-fuel ratio feedback control. When the intake air flow quantity Qa is small, the detection delay time becomes longer due to an exhaust transport delay and the dead time becomes longer. If the air-fuel ratio state is to be restrained on the switching line with a steep inclination when the dead time is long, the convergence stability and convergence response characteristic are deteriorated. Therefore, to avoid such deterioration, the inclination of the switching line is made gradual. However, when the intake air flow quantity Qa is large and the detection delay time (dead time) is short, even if the inclination of the switching line is made steep, the convergence stability and convergence response characteristic to the switching line are not deteriorated. So, the air-fuel ratio state is feedback controlled to the target air-fuel ratio at a maximum response characteristic by making the inclination of the switching steep.

At a transient correction term computing unit 108, a correction value K2 is set for correcting the basic value Ki based upon a differential value of the intake air flow quantity Qa. To be specific, when the differential value of the intake air flow quantity Qa is positive (when the intake air flow quantity Qa is increasingly changed), the correction value K2 is set to be a positive value. When the differential value of the intake air flow quantity Qa is negative (when the intake air flow quantity Qa is decreasingly changed), the correction value K2 is set to be a negative value. The larger an absolute value of the differential value of the intake air flow quantity Qa is, the larger the correction value K2 becomes.

Since the basic value K1 is set based upon an instantaneous value of the intake air flow quantity Qa, when the intake air flow quantity Qa is being changed, there occurs a delay in setting the inclination. Therefore, a changing direction and changing velocity of the intake air flow quantity Qa (in other words, detection delay time) are judged from the differential value of the intake air flow quantity Qa, and the basic value K1 is corrected by the correction value K2 in accordance with the differential value of the intake air flow quantity Qa so that the inclination (inclination coefficient K) is set following, without delay, a change in the detection delay time due to a change in the intake air flow quantity Qa.

At an inclination coefficient computing unit 109, the correction value K2 is added to the basic value K1 to set an inclination coefficient K, to output to the switching function computing unit 103.

In the above description, the intake air flow quantity Qa is used as the engine operating conditions participating in the detection delay time of air-fuel ratio. Since the detection delay time of air-fuel ratio is also changed with an engine rotation speed Ne, the inclination coefficient K may be set in accordance with the engine rotation speed Ne as shown in FIG. 5, instead of the intake air flow quantity Qa.

Figure 5:
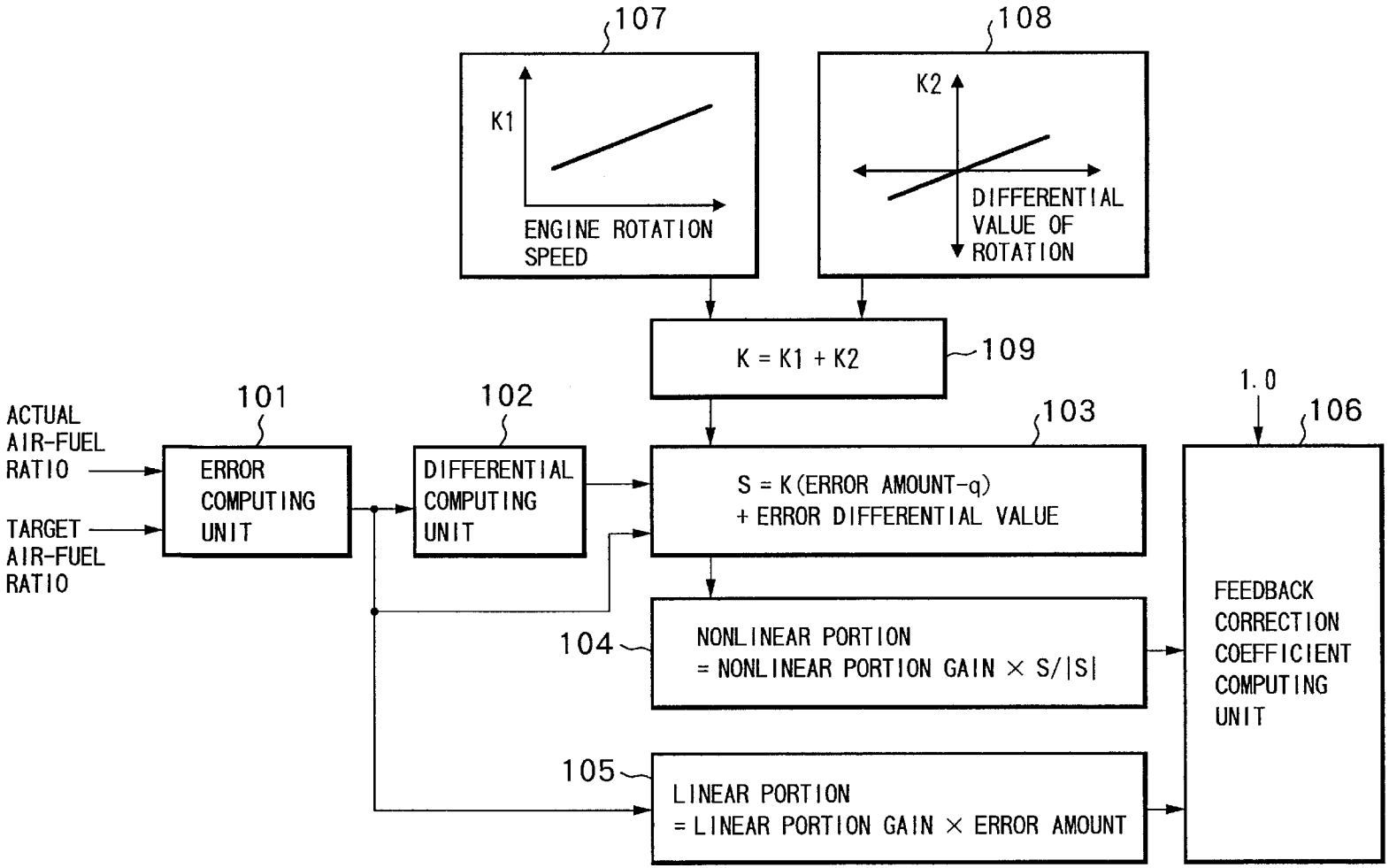
FIG. 5 is a control block diagram showing an air-fuel ratio feedback control for setting an inclination of a switching line in accordance with a rotation speed.

A second embodiment shown in FIG. 5 differs only in the processing contents of the basic value computing unit 107 and the transient correction term computing unit 108 from those in the first embodiment shown in FIG. 3. Accordingly, in the second embodiment, processing contents of the basic value computing unit 107 and the transient correction term computing unit 108 only will be explained as follows.

In the second embodiment shown in FIG. 5, at the basic value computing unit 107, a basic value K1 of an inclination coefficient K is set to be larger value when the engine rotation speed Ne is higher and the detection delay time of air-fuel ratio is shorter.

Namely, when the engine rotation speed is low, since the detection delay time of air-fuel ratio becomes long and the dead time of feedback control becomes long due to the exhaust transport delay, a small value is set as the basic value K1 to make the inclination of the switching line gradual. On the other hand, when the engine rotation speed is high, since the exhaust transport delay becomes short and the detection delay time of air-fuel ratio becomes short, a relatively large value is set as the basic value K1 to make the inclination of the switching line steep.

At the transient correction term computing unit 108, a correction value K2 is set to a positive value when a differential value of the engine rotation speed Ne is positive (when the engine rotation speed Ne is increasingly changed). When the differential value of the engine rotation speed Ne is negative (when the engine rotation speed Ne is decreasingly changed), the correction value K2 is set to a negative value. Thus, the larger an absolute value of the differential value of the engine rotation speed Ne, the larger an absolute value of the correction value K2 becomes.

An inclination coefficient K may be set based upon both the intake air flow quantity Qa and the engine rotation speed Ne.

The entire contents of Japanese Patent Application No. 2000-072325, filed on Mar. 15, 2000 is incorporated herein by the reference.

What is claimed:

1. An air-fuel ratio feedback control apparatus for controlling an air-fuel ratio of a combustion mixture in an internal combustion engine to a target air-fuel ratio, comprising:

an air-fuel ratio sensor for detecting said air-fuel ratio;

a fuel injection valve for injecting fuel into said internal combustion engine; and a control unit for feedback controlling a fuel injection quantity of said fuel injection valve so that an actual air-fuel ratio detected by said air-fuel ratio sensor is in conformity with a target air-fuel ratio, by a sliding mode control for restraining an air-fuel ratio state on a switching line set on a phase plane shown by a deviation between said actual air-fuel ratio detected by said air-fuel ratio sensor and said target air fuel ratio and a differential value of said deviation, wherein said control unit changes an inclination of said switching line in accordance with a change in dead time of said feedback control based upon engine operating conditions.

2. An air-fuel ratio feedback control apparatus in an internal combustion engine according to claim 1, wherein said control unit sets said dead time as a delay time in detecting an air-fuel ratio by said air-fuel ratio sensor, to set the inclination of said switching line in accordance with the engine operating conditions participating in said detection delay time of air-fuel ratio.

3. An air-fuel ratio feedback control apparatus in an internal combustion engine according to claim 2, wherein said control unit sets said engine operating conditions participating in said detection delay time of air-fuel ratio as an engine intake air quantity, to set the inclination of said switching line in accordance with said engine intake air quantity.

4. An air-fuel ratio feedback control apparatus in an internal combustion engine according to claim 3, wherein said control unit corrects the inclination of said switching line set in accordance with said engine intake air quantity, in accordance with a differential value of the intake air quantity.

5. An air-fuel ratio feedback control apparatus in an internal combustion engine according to claim 2, wherein said control unit sets the engine operating conditions participating in the detection delay time of air-fuel ratio as an engine rotation speed, to set the inclination of said switching line in accordance with said engine rotation speed.

6. An air-fuel ratio feedback control apparatus in an internal combustion engine according to claim 5, wherein said control unit corrects the inclination of said switching line set in accordance with the engine rotation speed, in accordance with a differential value of the engine rotation speed.

7. An air-fuel ratio feedback control apparatus in an internal combustion engine according to claim 1, wherein said control unit sets S=K×(deviation−predetermined value)+differential value of deviation when a switching function showing said switching line is S, and the inclination is K.

8. An air-fuel ratio feedback control apparatus in an internal combustion engine according to claim 1, wherein said control unit calculates, when S is a switching function showing said switching line:

a nonlinear portion as nonlinear portion=nonlinear portion gain×S/|S|; and a linear portion as linear portion=linear portion gain×said deviation; and calculates a feedback correction coefficient for correcting said fuel injection quantity based on said nonlinear portion and said linear portion.

9. An air fuel ratio feedback control apparatus for controlling an air-fuel ratio of a combustion mixture in an internal combustion engine to a target air-fuel ratio, comprising:

a deviation computing unit for computing a deviation between an actual air-fuel ratio and the target air-fuel ratio;

a differential value computing unit for computing a differential value of said deviation;

a nonlinear portion computing unit for computing a nonlinear portion, using said deviation and a differential value of deviation when an inclination is K and a switching function is S, as $$S=K\times(\text{deviation}-\text{predetermined value})+\text{differential value of deviation},$$

and $$\text{nonlinear portion}=\text{nonlinear portion gain}\times S/|S|;$$

a linear portion computing unit for computing a linear portion using said deviation, as $$\text{linear portion}=\text{linear portion gain}\times\text{deviation};$$

a feedback correction coefficient computing unit for computing a feedback correction coefficient for correcting a fuel injection quantity into said engine based upon said nonlinear portion and said linear portion;

a basic value computing unit for computing a basic value K1 of said inclination K based upon an engine intake air quantity;

a transitional correction term computing unit for computing a transient correction factor K2 based upon a differential value of said intake air quantity; and an inclination computing unit for computing said inclination K based upon said basic value K1 and said transient correction term K2.

10. An air fuel ratio feedback control apparatus for controlling an air-fuel ratio of a combustion mixture in an internal combustion engine to a target air-fuel ratio, comprising:

a deviation computing unit for computing a deviation between an actual air-fuel ratio and the target air-fuel ratio;

a differential value computing unit for computing a differential value of said deviation;

a nonlinear portion computing unit for computing a nonlinear portion, using said deviation and a differential value of deviation when an inclination is K and a switching function is S, as $$S=K\times(\text{deviation}-\text{predetermined value})+\text{differential value of deviation},$$

and $$\text{nonlinear portion}=\text{nonlinear portion gain}\times S/|S|;$$

a linear portion computing unit for computing a linear portion using said deviation, as $$\text{linear portion}=\text{linear portion gain}\times\text{deviation};$$

a feedback correction coefficient computing unit for computing a feedback correction coefficient for correcting a fuel injection quantity into said engine based upon said nonlinear portion and said linear portion;

a basic value computing unit for computing a basic value K1 of said inclination K based upon an engine rotation speed;

a transitional correction term computing unit for computing a transient correction factor K2 based upon a differential value of said engine rotation speed; and an inclination computing unit for computing said inclination K based upon said basic value K1 and said transient correction term K2.

11. An air fuel ratio feedback control method for controlling an air-fuel ratio of a combustion mixture in an internal combustion engine to a target air-fuel ratio, comprising the steps:

changing an inclination of a switching line set on a phase plane shown by a deviation between said actual air-fuel ratio detected by said air-fuel ratio sensor and said target air fuel ratio and a differential value of said deviation in accordance with a change in dead time of a feedback control based upon engine operating conditions; and feedback controlling an actual air-fuel ratio to the target air-fuel ratio by a sliding mode control for restraining an air-fuel ratio state on said switching line.

12. An air-fuel ratio feedback control method in an internal combustion engine according to claim 11, wherein said step of changing an inclination of a switching line sets the inclination of said switching line in accordance with, as said dead time, the engine operating conditions participating in said detection delay time of air-fuel ratio.

13. An air-fuel ratio feedback control method in an internal combustion engine according to claim 12, wherein said step of changing an inclination of a switching line sets said engine operating conditions participating in said detection delay time of air-fuel ratio as an engine intake air quantity, to set the inclination of said switching line in accordance with said engine intake air quantity.

14. An air-fuel ratio feedback control method in an internal combustion engine according to claim 12, wherein said step of changing an inclination of a switching line comprises the steps of:

setting said engine operating conditions participating in said detection delay time of air-fuel ratio as an engine intake air quantity, to set the inclination of said switching line in accordance with said engine intake air quantity; and correcting the inclination of said switching line set in accordance with said engine intake air quantity, in accordance with a differential value of the engine intake air quantity.

15. An air-fuel ratio feedback control method in an internal combustion engine according to claim 12, wherein said step of changing an inclination of a switching line sets the engine operating conditions participating in the detection delay time of air-fuel ratio as an engine rotation speed, to set the inclination of said switching line in accordance with said engine rotation speed.

16. An air-fuel ratio feedback control method in an internal combustion engine according to claim 12, wherein said step of changing an inclination of a switching line comprises the steps of:

setting the engine operating conditions participating in the detection delay time of air-fuel ratio as an engine rotation speed, to set the inclination of said switching line in accordance with said engine rotation speed; and correcting the inclination of said switching line set in accordance with the engine rotation speed, in accordance with a differential value of the engine rotation speed.

17. An air-fuel ratio feedback control method in an internal combustion engine according to claim 11, wherein said step of feedback controlling an actual air-fuel ratio to the target air-fuel ratio sets S=K×(deviation−predetermined value)+differential value of deviation when a switching function showing said switching line is S, and the inclination is K.

18. An air-fuel ratio feedback control method in an internal combustion engine according to claim 11, wherein said step of feedback controlling an actual air-fuel ratio to the target air-fuel ratio comprises the steps of:

calculating, when S is a switching function showing said switching line, a nonlinear portion as nonlinear portion=nonlinear portion gain×S/|S| and a linear portion as linear portion=linear portion gain×said deviation; and calculating a feedback correction coefficient for correcting a fuel injection quantity into said engine based on said nonlinear portion and said linear portion.

* * * * *